US006019160A

United States Patent [19]

Chen

[11] Patent Number: 6,019,160

[45] Date of Patent: Feb. 1, 2000

[54] HEAT TRANSFER ELEMENT ASSEMBLY

[75] Inventor: Michael M. Chen, Wellsville, N.Y.

[73] Assignee: ABB Air Preheater, Inc., Wellsville, N.Y.

[21] Appl. No.: 09/212,725

[22] Filed: Dec. 16, 1998

[51] Int. Cl.[7] ..... F28D 19/00

[52] U.S. Cl. ..... 165/10; 165/4; 165/166

[58] Field of Search ..... 165/4, 6, 8, 10, 165/166

[56] References Cited

U.S. PATENT DOCUMENTS

| | | | |
|---|---|---|---|
| 3,554,273 | 1/1971 | Kritzler | 165/10 |
| 4,345,640 | 8/1982 | Cullinan | 165/10 |
| 4,396,058 | 8/1983 | Kurschner et al. | 165/8 |
| 4,449,573 | 5/1984 | Pettersson et al. | 165/10 |
| 4,744,410 | 5/1988 | Groves | 165/10 |
| 5,803,158 | 9/1998 | Harder et al. | 165/10 |
| 5,836,379 | 11/1998 | Counterman | 165/10 |
| 5,899,261 | 5/1999 | Brzytwa et al. | 165/10 X |

*Primary Examiner*—Christopher Atkinson
*Attorney, Agent, or Firm*—Alix, Yale & Ristas, LLP

[57] ABSTRACT

The thermal performance of the heat transfer element assemblies for rotary regenerative air preheaters is optimized to provide a desired level of heat transfer and pressure drop with a reduced volume and weight. The heat transfer plates in the assemblies have notches for maintaining plate spacing and oblique undulations between the notches. The undulations on adjacent plates extend at opposite oblique angles. The ratio of the openings of the undulations to the openings of the notches is greater than 0.3 and less than 0.5. The pitch (spacing) of the notches is greater than two inches and the angle of the undulations with respect to the notches is greater than 20° and less than 40°.

1 Claim, 6 Drawing Sheets

HEAT TRANSFER ELEMENT ASSEMBLY

BACKGROUND OF THE INVENTION

The present invention relates to heat transfer element assemblies and, more specifically, to an assembly of heat absorbent plates for use in a heat exchanger wherein heat is transferred by means of the plates from a hot heat exchange fluid to a cold heat exchange fluid. More particularly, the present invention relates to a heat exchange element assembly adapted for use in a heat transfer apparatus of the rotary regenerative type wherein the heat transfer element assemblies are heated by contact with the hot gaseous heat exchange fluid and thereafter brought in contact with cool gaseous heat exchange fluid to which the heat transfer element assemblies gives up its heat.

One type of heat exchange apparatus to which the present invention has particular application is the well-known rotary regenerative heater. A typical rotary regenerative heater has a cylindrical rotor divided into compartments in which are disposed and supported spaced heat transfer plates which, as the rotor turns, are alternately exposed to a stream of heating gas and then upon rotation of the rotor to a stream of cooler air or other gaseous fluid to be heated. As the heat transfer plates are exposed to the heating gas, they absorb heat therefrom and then when exposed to the cool air or other gaseous fluid to be heated, the heat absorbed from the heating gas by the heat transfer plates is transferred to the cooler gas. Most heat exchangers of this type have their heat transfer plates closely stacked in spaced relationship to provide a plurality of passageways between adjacent plates for flowing the heat exchange fluid therebetween.

In such a heat exchanger, the heat transfer capability of a heat exchanger of a given size is a function of the rate of heat transfer between the heat exchange fluid and the plate structure. However for commercial devices, the utility of a device is determined not alone by the coefficient of heat transfer obtained, but also by other factors such as cost and weight of the plate structure. Ideally, the heat transfer plates will induce a highly turbulent flow through the passages therebetween in order to increase heat transfer from the heat exchange fluid to the plates while at the same time providing relatively low resistance to flow between the passages and also presenting a surface configuration which is readily cleanable.

To clean the heat transfer plates, it has been customary to provide soot blowers which deliver a blast of high pressure air or steam through the passages between the stacked heat transfer plates to dislodge any particulate deposits fro the surface thereof and carry them away leaving a relatively clean surface. One problem encountered with this method of cleaning is that the force of the high pressure blowing medium on the relatively thin heat transfer plates can lead to cracking of the plates unless a certain amount of structural rigidity is designed into the stack assembly of heat transfer plates.

One solution to this problem is to crimp the individual heat transfer plates at frequent intervals to provide double-lobed notches which have one lobe extending away from the plate in one direction and the other lobe extending away from the plate in the opposite direction. Then when the plates are stacked together to form the heat transfer element assembly, these notches serve to maintain adjacent plates so that forces placed on the plates during the soot blowing operation can be equilibrated between the various plates making up the heat transfer element assembly.

A heat transfer element assembly of this type is disclosed in U.S. Pat. No. 4,396,058. In the patent, the notches extend in the direction of the general heat exchange fluid flow, i.e., axially through the rotor. In addition to the notches, the plates are corrugated to provide a series of oblique furrows or undulations extending between the notches at an acute angle to the flow of heat exchange fluid. The undulations on adjacent plates extend obliquely to the line of flow either in an aligned manner or oppositely to each other. Although such heat transfer element assemblies exhibit favorable heat transfer rates, the results can vary rather widely depending upon the specific design and relationship of the notches and undulations.

SUMMARY OF THE INVENTION

An object of the present invention is to provide an improved heat transfer element assembly wherein the thermal performance is optimized to provide a desired level of heat transfer and pressure drop with assemblies having a reduced volume and weight. In accordance with the invention, the heat transfer plates of the heat transfer element assembly have longitudinal bibbed notches and oblique undulations between notches wherein the thermal performance is optimized by providing specific ranges for the ratio of the openings provided by the undulations to the openings provided by the notches, the spacing between notches and the angle between the undulations and the notches. The undulations on adjacent plates extend in opposite directions with respect to each other and the direction of fluid flow.

DESCRIPTION OF THE PREFERRED EMBODIMENT

Figure 1:
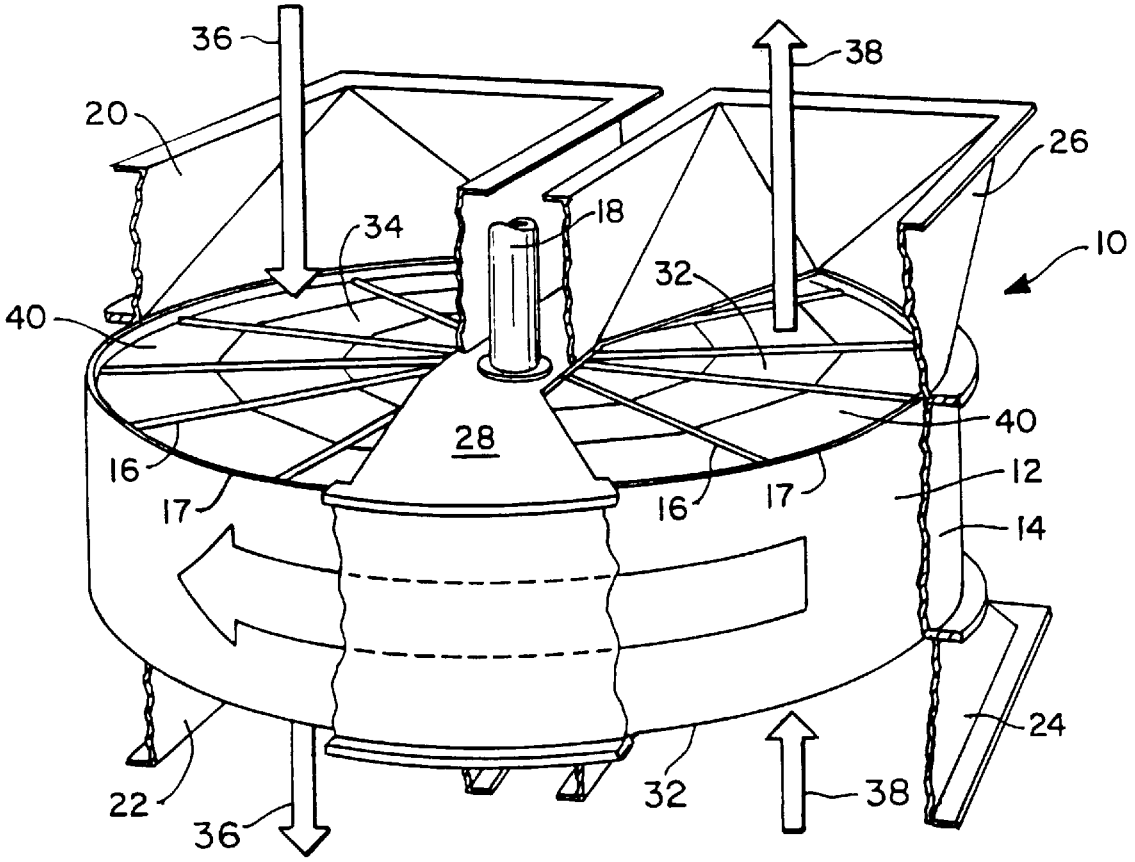
Fig. 1 (Prior Art)
FIG. 1 is a perspective view of a conventional rotary regenerative air preheater which contains heat transfer element assemblies made up of heat transfer plates.

With reference to FIG. 1 of the drawings, a conventional rotary regenerative preheater is generally designated by the numerical identifier 10. The air preheater 10 has a rotor 12 rotatably mounted in a housing 14. The rotor 12 is formed of diaphragms or partitions 16 extending radially from a rotor post 18 to the outer periphery of the rotor 12. The partitions 16 define compartments 17 therebetween for containing heat exchange element assemblies 40.

Figure 2:
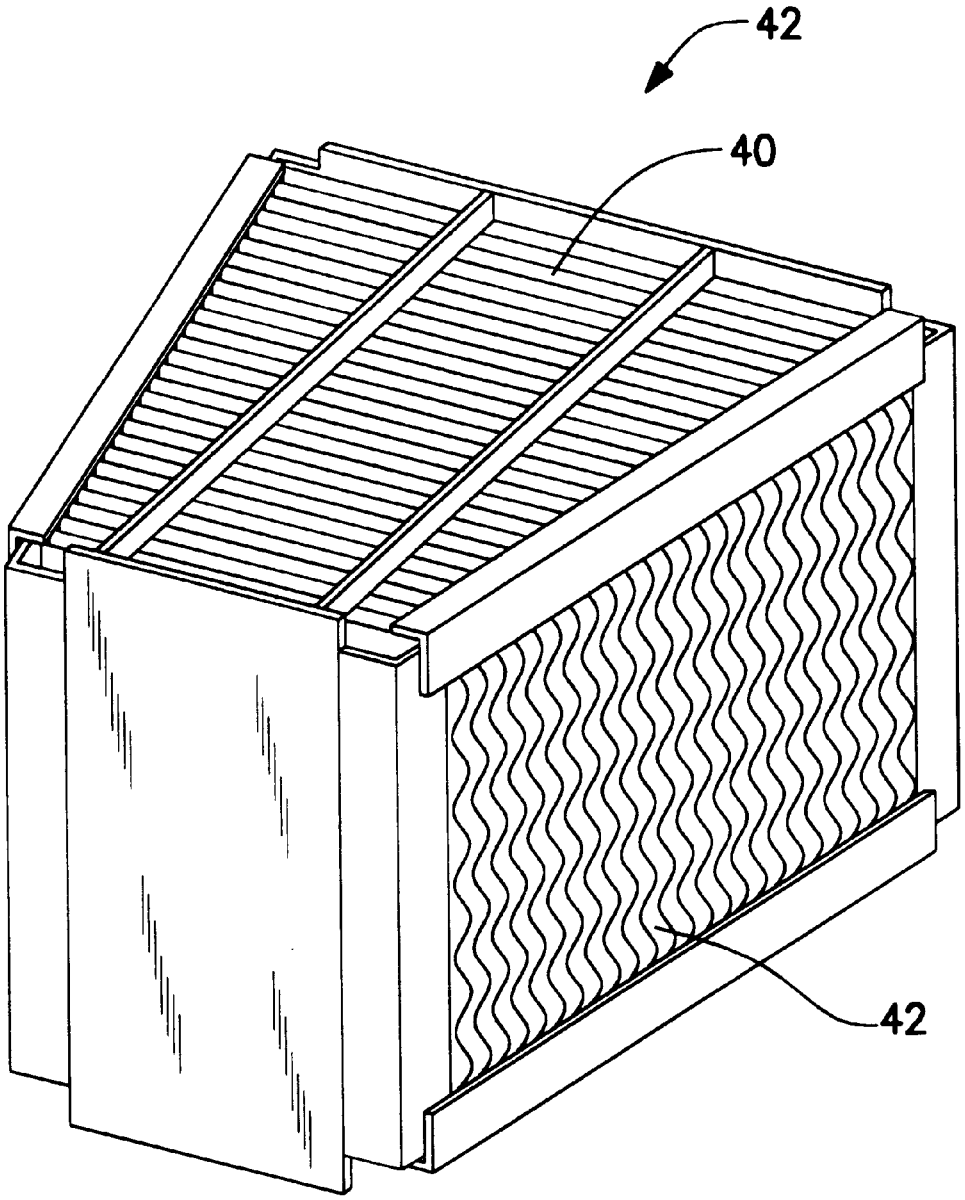
Fig. 2 (Prior Art)
FIG. 2 is a perspective view of a conventional heat transfer element assembly showing the heat transfer plates stacked in the assembly.

The housing 14 defines a flue gas inlet duct 20 and a flue gas outlet duct 22 for the flow of heated flue gases through the air preheater 10. The housing 14 further defines an air inlet duct 24 and an air outlet duct 26 for the flow of combustion air through the preheater 10. Sector plates 18 extend across the housing 14 adjacent the upper and lower faces of the rotor 12. The sector plates 28 divide the air preheater 10 into an air sector and a flue gas sector. The arrows of FIG. 1 indicate the direction of a flue gas stream 36 and an air stream 38 through the rotor 12. The hot flue gas stream 36 entering through the flue gas inlet duct 20 transfers heat to the heat transfer element assemblies 40 mounted in the compartments 17. The heated heat transfer element assemblies 40 are then rotated to the air sector 32 of the air preheater 10. The stored heat of the heat transfer element assemblies 40 is then transferred to the combustion air stream 38 entering through the air inlet duct 24. The cold flue gas stream 36 exits the preheater 10 through the flue gas outlet duct 22, and the heated air stream 38 exits the preheater 10 through the air outlet duct 26. FIG. 2 illustrates a typical heat transfer element assembly or basket 40 showing a general representation of heat transfer plates 42 stacked in the assembly.

Figure 3:
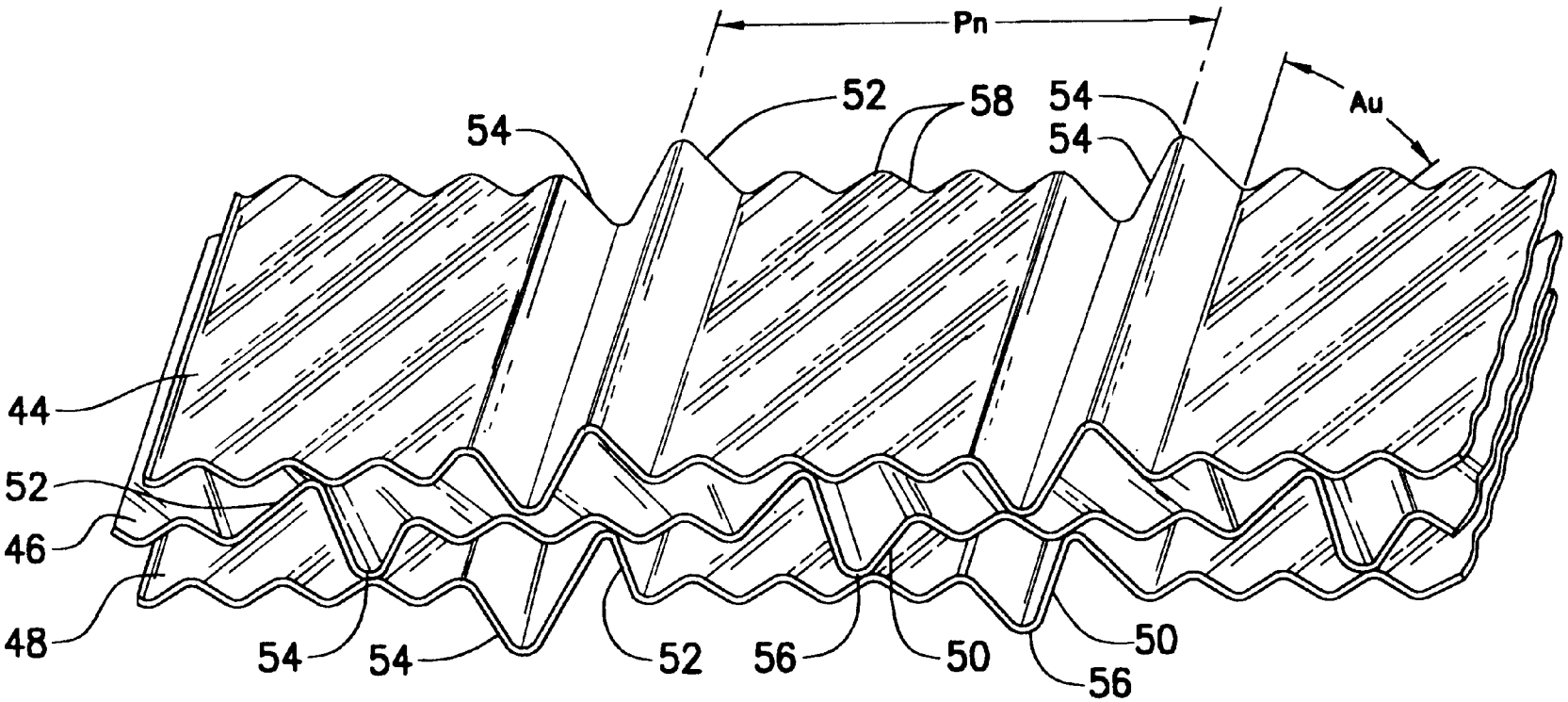
FIG. 3 is a perspective view of portions of three heat transfer plates for a heat transfer element assembly in accordance with the present invention illustrating the spacing of the notches and the angle of the undulations.

FIG. 3 depicts one embodiment of the invention showing portions of three stacked heat transfer plates 44, 46 and 48. In this FIG. 3 embodiment, all of the heat transfer plates are basically identical with every other plate being rotated 180° to produce the configuration shown. The plates are thin sheet metal capable of being rolled or stamped to the desired configuration. Each plate has a series of bibbed notches 50 at spaced intervals which extend longitudinally and parallel to the direction of the flow of the heat exchange fluid through the rotor of the air preheater. These notches 50 maintain adjacent plates a predetermined distance apart and form the flow passages between the adjacent plates. Each bibbed notch 50 comprises one lobe 52 projecting outwardly from the surface of the plate on one side and another lobe 54 projecting outwardly from the surface of the plate on the other side. Each lobe is essentially in the form of a V-shaped groove with the apexes 56 of the grooves directed outwardly from the plate in opposite directions. As can be seen in this FIG. 3, the apexes 56 of the notches 50 engage the adjacent plates to maintain the plate spacing. As also noted, the plates are arranged such that the notches on one plate are located about mid-way between the notches on the adjacent plates for maximum support. The pitch of the notches 50, i.e., the distance between notches, is designated Pn.

The plates each have undulations or corrugations 58 in the sections between the notches 50. These undulations 58 extend between adjacent notches at an angle to the notches designated as angle Au. As shown in this FIG. 3, the undulations on adjacent plates extend in opposite directions with respect to each other and the direction of the fluid flow. It can also be seen from this FIG. 3 that the plates 44, 46 and 48 are identical to each other with the plate 46 merely being rotated 180° from the plates 44 and 48. This is advantageous in that only one type of plate needs to be manufactured.

Figure 4:
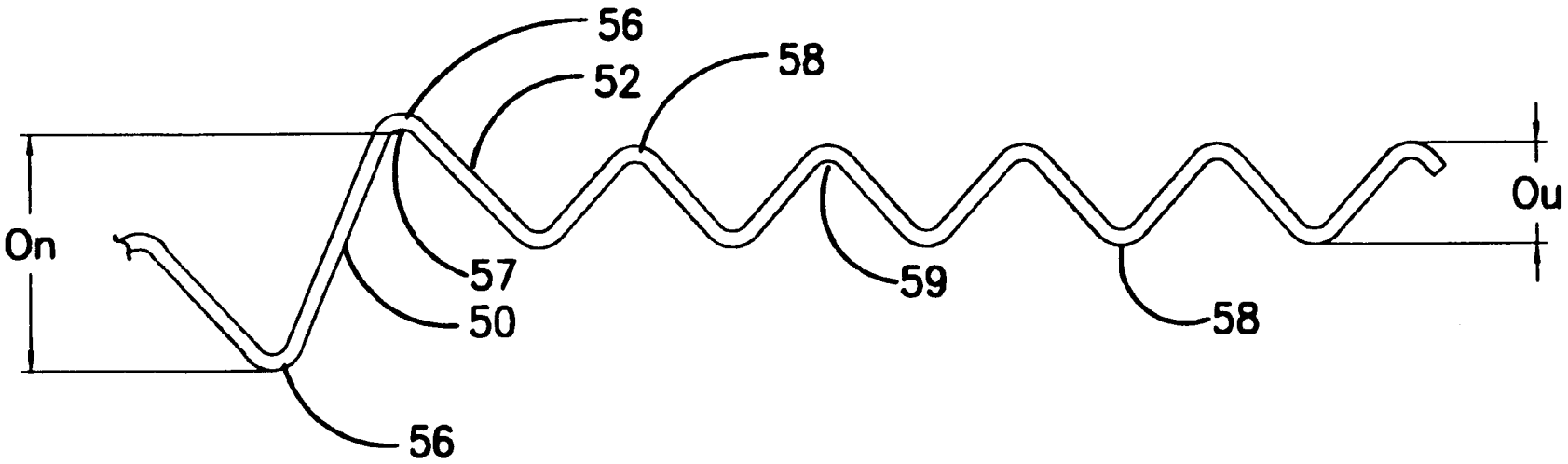
FIG. 4 is an end view of one of the plates of FIG. 3 illustrating the relative openings of the notches and undulations.

FIG. 4 is an end view of a portion of one of the plates of FIG. 3 showing the notches 50, the lobes 52 and 54 and the undulations 58. The opening of the notches 50 is the distance On from an apex 56 to a valley 57. The opening of the undulations 58 is the distance Ou from an apex 58 to a valley 59. In accordance with the present invention, the optimum thermal performance and the reduced heat exchange element assembly volume and weight is achieved with the configuration parameters in the following ranges:

$$0.5>Ou/On>0.3$$

$$Pn>2 \text{ inches}$$

$$40°>Au>20°$$

Figure 5:
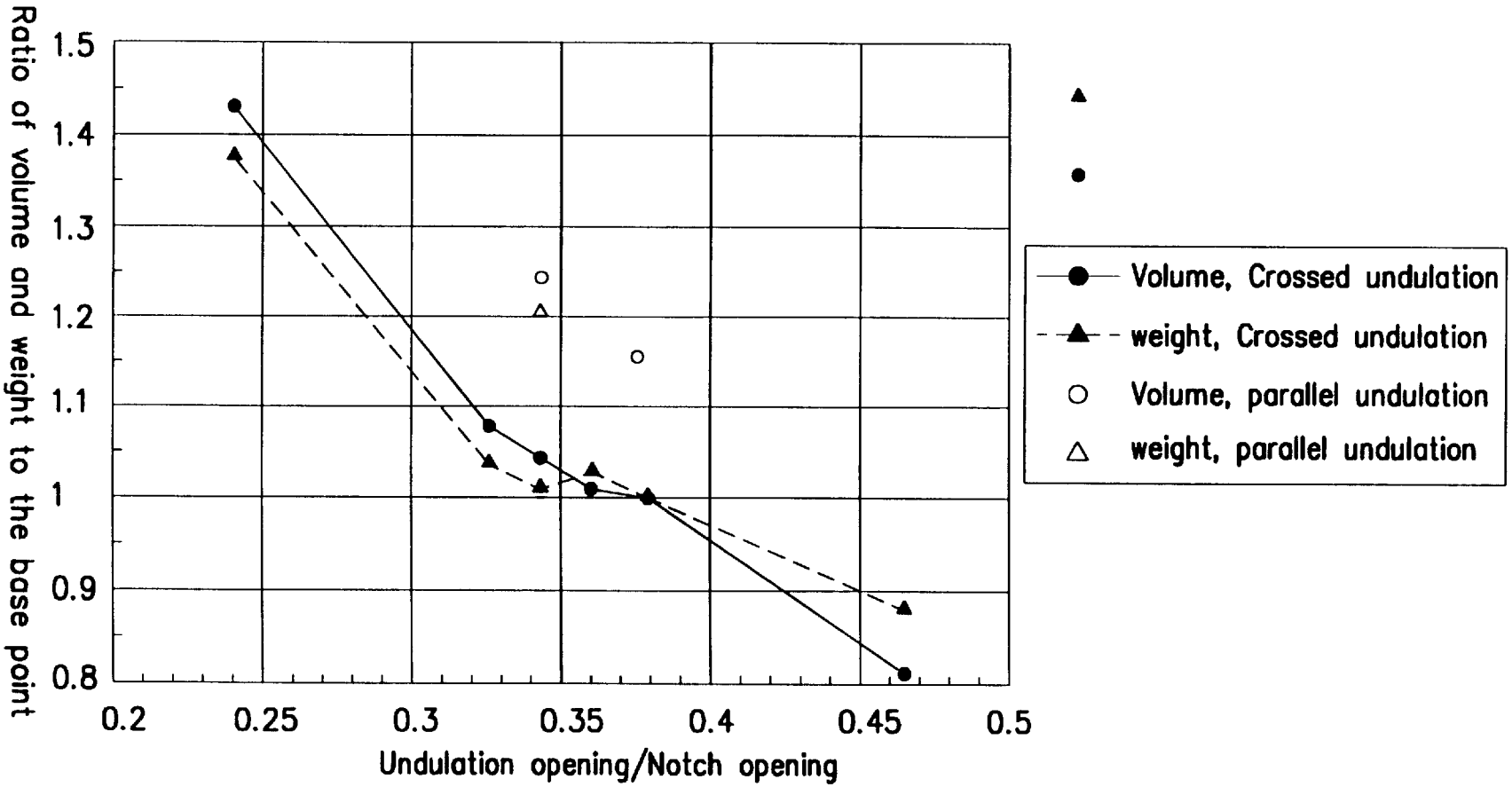
FIG. 5 is a graph showing the changes in the ratio of the volume and weight of the heat transfer element assemblies compared to a base point as a function of the ratio of the undulations openings to the notch openings for a constant heat transfer and pressure drop.

FIG. 5 is a graph which illustrates the benefits of the invention with respect to one of the configuration parameters, the ratio of Ou to On. The graph shows the results of test of samples having various ratios of Ou/On. Furthermore, the graph also illustrates the difference between undulations which are parallel on adjacent plates and undulations which are at opposite angles (crossed) on adjacent plates.

The graph shows the ratio of the volume and the ratio of the weight of the heat exchange element assemblies compared to a base volume and weight as a function of the ratio of Ou to On. The base volume and weight is taken where the ratio Ou/On=0.375. As can be seen, when the ratio Ou/On decreases from this base point, the volume and weight increase. According to the present invention, the lower limit of the ratio of Ou/On is 0.3 where the volume and weight are still within acceptable limits. Although an increase in the ratio Ou/On produced more favorable volume and weight ratios, the practical limit of the height of the undulations compared to the opening of the notches is reached at a ratio Ou/On=0.5. Other tests show that the heat transfer factor (Coburn j factor) is increased approximately 47% when the ratio Ou/On is increased from 0.237 to 0.375.

Using the parameters of the present invention, a swirl flow is created including vortices and secondary flow patterns. The flow impinges the plates and enhances heat transfer. The swirl also serves to mix the flowing fluid and provide a more uniform flow temperature. The swirl flow then impinges the plates again down stream. This process of impingement and mixing continues and enhances the heat transfer rate without increases in pressure drop resulting in reduced volume and weight for the assemblies for the same amount of total heat transferred.

Figure 6:
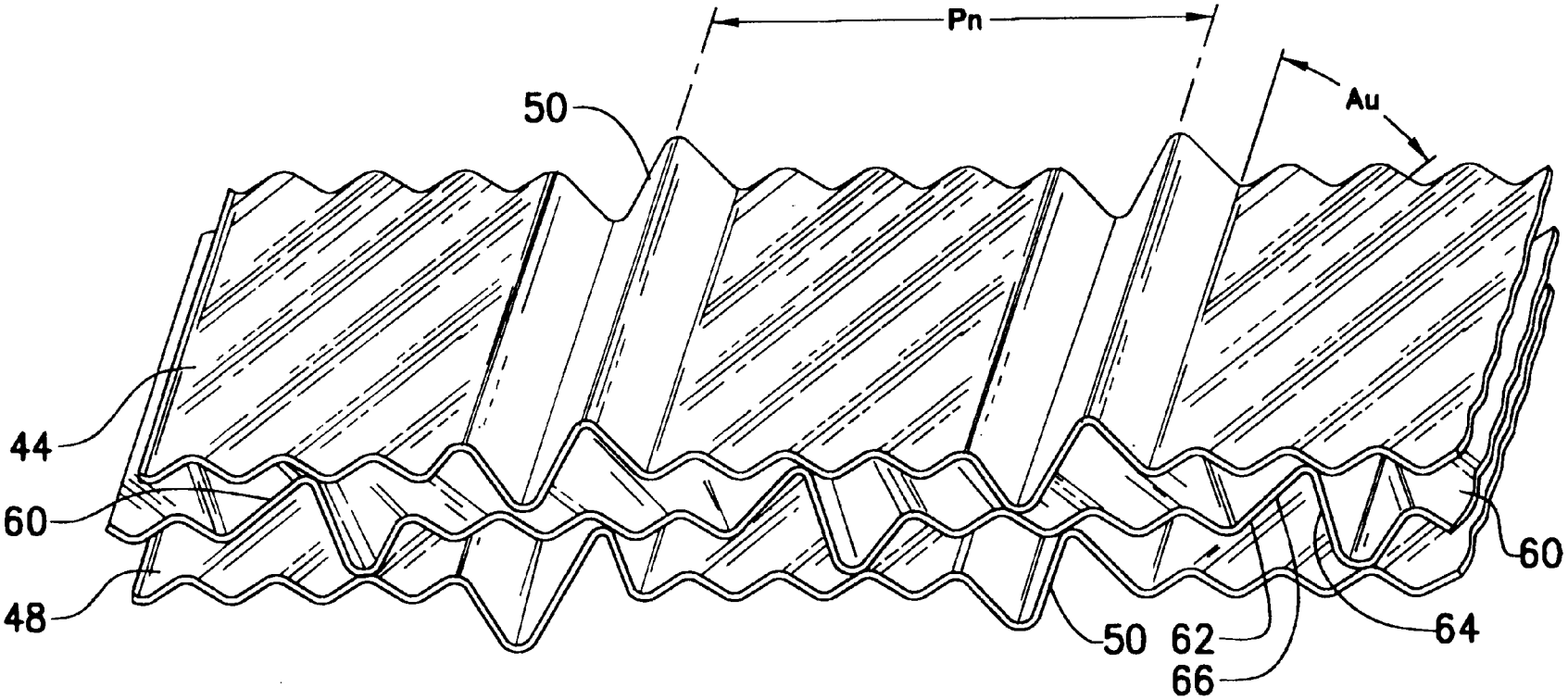
FIG. 6 is a view similar to FIG. 3 illustrating a variation of the invention.

FIG. 6 shows a variation of the invention where the plates 44 and 48 are the same as the corresponding plates in FIG. 3. However, plate 60 in FIG. 6 differs from plate 46 in FIG. 3. As illustrated, the lobes 62 and 64 of the notches 66 in plate 60 are reversed in direction from the corresponding lobes 52 and 54 in FIG. 3. Therefore, plate 60 is not identical to the plates 44 and 48 but the same parameters of the invention still apply and the undulations on adjacent plates still extend in opposite directions.

I claim:

1. A heat transfer assembly for a heat exchanger comprising a plurality of first heat absorbent plates and a plurality of second heat absorbent plates stacked alternately in spaced relationship thereby providing a plurality of passageways between adjacent first and second plates for flowing a heat exchange fluid therebetween, each of said first and second plates having:

a. a plurality of bibbed notches extending parallel to each other and spaced apart a distance Pn and each comprising a first lobe projecting outwardly from one side of said plate and a second lobe projecting outwardly from the other side of said plate and wherein the opening of said notches form the top of said lobe on said one side to the valley of said lobe on said other side is On, said notches forming spacers between adjacent plates; and b. a plurality of undulations extending between and at an angle Au to said notches, said undulations having an opening Ou from the top of one undulation to the valley of the adjacent undulation; and wherein the ratio of Ou/On is greater than 0.3 and less than 0.5, Pn is greater than two inches and Au is greater than 20° and less than 40° to thereby optimize the thermal performance and minimize the volume and weight of said heat transfer assemblies and wherein the undulations on adjacent plates extend at opposite angles with respect to said notches.

* * * * *

UNITED STATES PATENT AND TRADEMARK OFFICE

CERTIFICATE OF CORRECTION

PATENT NO. : 6,019,160
DATED : February 1, 2000
INVENTOR(S) : Chen

It is certified that error appears in the above-identified patent and that said Letters Patent is hereby corrected as shown below:

Column 4,
Line 46, delete "bibbed" and insert -- bilobed --.

Signed and Sealed this

Eighth Day of January, 2002

*Attest:*

*Attesting Officer*

JAMES E. ROGAN
*Director of the United States Patent and Trademark Office*